US007101217B2

(12) United States Patent
Hayashi

(10) Patent No.: US 7,101,217 B2
(45) Date of Patent: Sep. 5, 2006

(54) SHIELD CONNECTOR

(75) Inventor: Hiroyuki Hayashi, Mie (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/969,069

(22) Filed: Oct. 21, 2004

(65) Prior Publication Data

US 2005/0142942 A1 Jun. 30, 2005

(30) Foreign Application Priority Data

Oct. 23, 2003 (JP) ..... P2003-363699
Oct. 23, 2003 (JP) ..... P2003-363700

(51) Int. Cl.
*H01R 13/56* (2006.01)
*H01R 13/40* (2006.01)

(52) U.S. Cl. ..... 439/447; 439/589

(58) Field of Classification Search ..... 439/447, 439/445, 587, 589, 274, 275, 610
See application file for complete search history.

(56) References Cited

U.S. PATENT DOCUMENTS 5,300,734 A * 4/1994 Suzuki ..... 174/152 G
5,564,716 A * 10/1996 Onoue et al. ..... 277/607
5,997,349 A * 12/1999 Yoshioka ..... 439/579
6,464,538 B1 * 10/2002 Miyazaki et al. ..... 439/610
6,749,464 B1 * 6/2004 Obata ..... 439/610
2002/0042228 A1 * 4/2002 Yoshioka ..... 439/610
2004/0092165 A1 * 5/2004 Holland ..... 439/607

FOREIGN PATENT DOCUMENTS

JP A 2002-281654 9/2002

* cited by examiner

*Primary Examiner*—Hien Vu
(74) *Attorney, Agent, or Firm*—Oliff & Berridge, PLC

(57) ABSTRACT

A terminal metal piece connected to an electric wire is inserted into a housing and an outer periphery of the housing is attached with a shield shell fixedly attached to a distal end of a shield member surrounding electric wires. Even when the electric wire is bent to be deviated from the regular wiring path, a resin cover is protected against interference with the shield shell by an outer cylinder portion. Further, a mode of protecting the resin cover against interference with the shield shell includes a case in which the resin cover is prevented from being interfered with the shield shell and a case in which even when the resin cover is interfered with the shield shell, the resin cover is avoided from being impaired thereby.

12 Claims, 10 Drawing Sheets

SHIELD CONNECTOR

BACKGROUND OF THE INVENTION

1. Field of the Invention

The present invention relates to a shield connector.

2. Description of the Related Art

There is a summarized shield connector summerizingly shielding a plurality of pieces of electric wires disclosed in JP-A-2002-281654. According thereto, a terminal metal piece connected to the electric wires is contained in a housing, a distal end portion of a shield member comprising braided wires in a cylindrical shape summerizingly surrounding the plurality of pieces of electric wires is attached to an outer periphery of the housing and at the attached portion, a shield shell made of a metal in a ring-like shape fixedly attached to the distal end portion of the shield member is covered on the outer periphery of the housing.

SUMMARY OF THE INVENTION

In the case of the connector in which the shield shell made of a metal is outwardly fitted to a rear end portion of the housing as described above, when the electric wire led out from a rear end face of the housing is deviated from a regular wiring path and forcibly bent to be folded back to a side of the housing, an insulating cover at an outer periphery of the electric wire is pressed to an edge of an outer peripheral edge of a rear end of the shield shell to be impaled thereby and therefore, there is a concern of impairing the resin cover for insulating by the edge.

It is an object thereof to protect a resin cover of an electric wire when the electric wire is deviated from a regular wiring path to be bent.

According to first aspect of the invention, a shield connector including; a terminal metal piece connected to at least one electric wire an outer periphery of which is covered with an insulating resin cover is inserted into a housing from a rear side; a shield shell made of a metal fixedly attached to a shield member surrounding the at least one electric wire is attached to an outer periphery of the housing; and a protecting member that protects the insulating resin cover against interference with the shield shell when the electric wire is bent to be deviated from a regular wiring path.

Thus, even when the electric wire is bent to deviate from the regular wiring path, the resin cover is protected against interference with the shield shell by the protecting member. Here, protection against interference with the shield shell includes a case in which the resin cover is prevented from being interfered with the shield shell and a case in which even when the resin cover is interfered with the shield shell, the resin cover is avoided from being impaired by the shield shell.

According to second aspect of the invention, when the electric wire is bent, the protecting member is deformable to interpose between the shield shell and the resin cover by being exerted with a press force from the electric wire.

Thus, when the electric wire is bent, the protecting member is deformed to interpose between the resin cover and the shield shell and therefore, interference between the resin cover and the shield shell can be avoided.

According to third aspect of the invention, the protecting member is formed at a rubber plug holder which prevents a rubber plug fitted to a rear end portion of the housing in a state of being penetrated with the electric wire from being drawn out.

Thus, the rubber plug holder serves also as the protecting member and therefore, in comparison with the case of providing an exclusive part as the protecting member, a number of parts is reduced.

According to fourth aspect of the invention, the rubber plug holder includes an inner cylinder portion extended to a rear side along an outer periphery of the electric wire and an outer cylinder portion substantially concentric with the inner cylinder and extended to the rear side along an inner periphery of the housing, an extended end of the outer cylinder portion is projected rearward from a rear end of the shield shell, and the outer cylinder portion is made to configure the protecting member.

Since the shield shell is the metal member attached to the outer periphery of the housing, when the electric wire is bent to be folded back to the front side at a vicinity of a rear end face of the housing, there is a concern of bringing the resin cover into contact with an edge of a rear end of the shield shell to be impaired thereby. In this respect, according to the invention, the outer cylinder portion, which serves as the protecting member, is spaced from the outer periphery of the electric wire and extends rearward beyond the rear end of the shield shell to thereby bend the electric wire at a vicinity of the extended end of the outer cylinder portion. Therefore, the electric wire is brought into contact with the shield shell in an attitude of being along an outer peripheral face of the shield shell. Therefore, even when the resin cover is brought into contact with the edge of the rear end of the shield shell, there is not a concern of impairing the resin cover by the edge of the rear end of the shield shell.

According to fifth aspect of the invention, an extended end of the inner cylinder portion is disposed frontward from the extended end of the outer cylinder portion.

Although the outer cylinder portion is disposed at the position separated from the inner cylinder portion to the outer side in the diameter direction, the extended end of the inner cylinder portion is disposed to the depth side frontward from the extended end of the outer cylinder portion and therefore, when the electric wire is bent to wire, a degree of freedom of setting the wiring path is not reduced by presence of the outer cylinder portion.

According to sixth aspect of the invention, the protecting member has an extended portion that extends rearward beyond the shield shell. The protecting member also has a reinforcing portion capable of restricting the extended portion from being deformed. Thus, when the electric wire is deviated from the regular wiring path to be bent to the front side, the electric wire is folded back at the rear end of the extended portion remote from the shield shell and therefore, even when the bent electric wire is brought into contact with the shield shell, the electric wire at this occasion is in an attitude of being along an outer peripheral face of the shield shell. Therefore, there is not a concern of impairing the resin cover even when the resin cover is brought into contact with an edge of the rear end of the shield shell.

Further, since the reinforcing portion capable of restricting the extended portion from being deformed is provided, there is not a concern of deforming the extended portion by being exerted with a press force from the electric wire and the extended portion can firmly achieve a function of protecting the electric wire against interference with the shield shell.

According to seventh aspect of the invention, the extended portion is formed at a rubber plug holder which prevents a rubber plug fitted to a rear end portion of the housing in a state of being penetrated by the electric wire from being drawn out.

Since the extended portion is formed at the rubber plug holder, in comparison with a case of providing an exclusive part of the extended portion, a number of pars is reduced.

According to eighth aspect of the invention, the rubber plug holder includes an inner cylinder portion extended to the rear side along an outer periphery of the electric wire and an outer cylinder portion substantially concentric with the inner cylinder and extended to the rear side along an inner periphery of the housing. The extended portion is configured by the inner cylinder portion and the outer cylinder portion. The reinforcing portion includes a rib connecting the inner cylinder portion and the outer cylinder portion in a diameter direction.

Since the extended portion is configured by double cylinder portions of the inner cylinder portion and the outer cylinder portion, in comparison with a case of constituting the extended portion by a cylinder portion having a single wall thickness, material cost can be reduced and further, a sink mark in molding by a die can be restrained. Further, although walls of the inner cylinder portion and the outer cylinder portion are thin, deformation of the cylinder portions can firmly be prevented by the reinforcing portion constituting a shape of the rib in the diameter direction.

According to ninth aspect of the invention, a rear end portion of the extended portion includes a guide face in a taper shape or an arc shape, an internal diameter of the guide face increasing with progression rearward.

By forming the guide face in the taper shape or the arc shape the diameter of which is enlarged from the inner peripheral face to the rear side at the extended end portion of the extended portion, the electric wire can unforcibly be bent by a comparatively large radius of curvature along the guide face and therefore, a degree of freedom of setting the wiring path is high when the electric wire is wired by being bent at a vicinity of the housing.

DESCRIPTION OF THE PREFERRED EMBODIMENTS

EMBODIMENT 1

Figure 1:
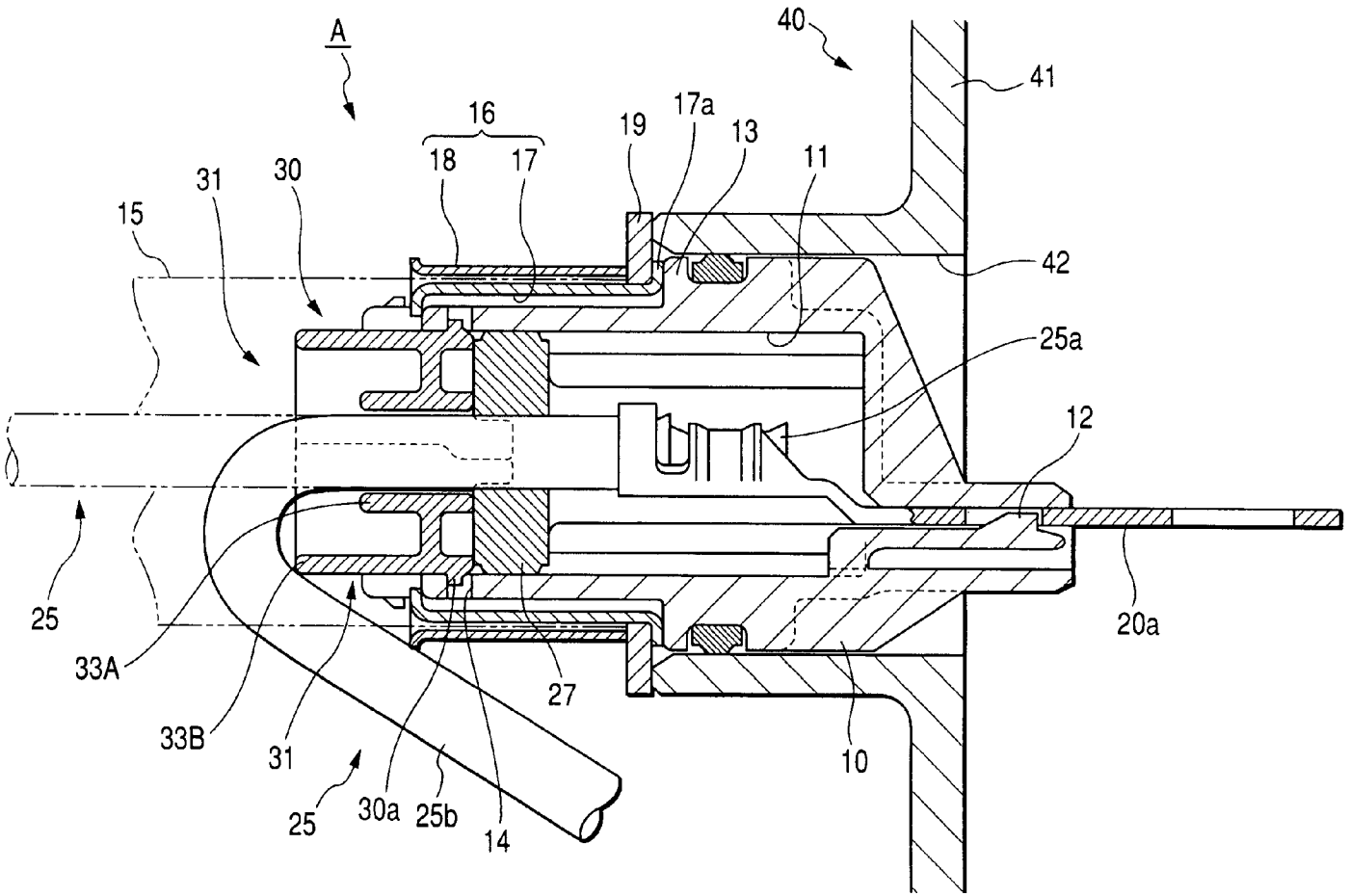
FIG. 1 is a sectional view showing a state of bending an electric wire according to Embodiment 1.

An explanation will be given of Embodiment 1 embodying the invention in reference to FIG. 1 through FIG. 5 and FIG. 10 as follows.

A shield connector A according to the embodiment is provided with a housing 10 made of a synthetic resin, and three (although according to the embodiment, three, may be two or four or more) of terminal metal pieces 20. Inside of the housing 10 is formed with three cavities 11 having a circular section penetrated in a front and rear direction to align by a constant pitch in a left and right direction (horizontal direction). The terminal metal pieces 20 are respectively inserted into the respective cavities 11 from a rear side and prevented from being drawn out by lances 12.

A rear end portion of the terminal metal piece 20 is connected with an electric wire 25 configured by surrounding an outer periphery of a core wire 25*a* by an insulating resin cover 25*b* by being brought into press contact therewith. An outer periphery of the resin cover 25*b* of the electric wire 25 constituting a circular shape is outwardly fitted with a rubber plug 27 in a cylindrical shape in liquid tight, an outer periphery of the rubber plug 27 is brought into close contact with an inner periphery of the cavity 11 in liquid tight and an interval between the outer periphery of the electric wire 25 and the inner periphery of the cavity 11 is waterproofed.

Further, a rear end portion of the housing 10 is attached with a rubber plug holder 30 for restricting the rubber plug 27 at inside of the cavity 11 from being detached to the rear side. The electric wire 25 is led out to the rear side by penetrating the rubber plug holder 30. Further, a detailed description will be given later of the rubber plug holder 30.

The housing 10 is fitted to an attaching hole 42 of a shield case 41 of an apparatus 40 (for example, an inverter apparatus, a motor or the like of an electric automobile), and a tab 20*a* of the terminal metal piece 20 projected from a front end of the housing 10 is connected to an apparatus side terminal, not illustrated.

Three pieces of the electric wires 25 are surrounded by a shield member 15 constituting a shape of a cylinder braided with metal slender wires in a mesh-like shape and the three pieces of electric wires 25 are summerizingly shielded by the shield member 15. A distal end portion of the shield member 15 is fixedly attached with a shield shell 16 made of a metal constituting a laterally prolonged oval shape (ring shape). The shield shell 16 is configured by a double cylinder structure of an inner ring 17 and an outer ring 18 and the distal end portion of the shield member 15 is pinched between the inner ring 17 and the outer ring 18 to be fixedly attached thereto by calking. The shield shell 16 is integrated with a bracket 19 integrated with the shield shell 16 by being pinched between a flange portion 17*a* of a front end portion of the inner ring 17 and a front end edge of the outer ring 18. The shield shell 16 is conductively integrated to the shield case 41 by fixing the bracket 19 to the shield case 41, in the integrated state, a front face of the bracket 19 is brought into contact with an enlarged diameter portion 13 at an outer periphery of the housing 10 fitted to the attaching hole 42 of the shield case 41 and by bringing the front face into contact with the enlarged diameter portion 13, the housing 10 is restricted from being detached from the attaching hole 42.

In a state of attaching the housing 10 and the shield shell 16 to the shield case 41 in this way, there is brought about a state of outwardly fitting the shield shell 16 to the outer periphery of the rear end portion of the housing 10, and a rear end edge of the shield shell 16 and a rear end of the housing 10 are disposed substantially at the same position in the front and rear direction. Therefore, according to a shield connector B having a structure of a related art shown in FIG. 10, when the electric wire 25 led out from the rubber plug holder 30 to the rear side is bent to be folded back to a lower side, the electric wire 25 is brought into contact with the rear end edge of the shield shell 16 to be butted thereto from the rear side and therefore, there is a concern of impairing the resin cover 25*b* by the edge of the rear end edge of the shield shell 16. Hence, according to the embodiment, the rubber plug holder 30 is provided by a structure of a countermeasure thereagainst. A detailed structure thereof will be explained as follows.

The rubber plug holder 30 is made of polypropylene and comprises a single part configured by connecting left ends of a pair of half divisions 31 symmetrical with each other in an up and down direction by a hinge 32. The half division 31 on an upper side and the half division 31 on a lower side are formed with respective threes of inner side half circular portions 33A in a half circular shape and outer side half circular portions 33B concentric with the inner side half circular portions 33A and having a diameter larger than that of the inner side half circular portions 33A in correspondence with outer peripheries of the respective electric wires 25 (resin covers 25*b*) aligned in the left and right direction. The inner side half circular portion 33A and the outer side half circular portion 33B brought into a concentric relationship are made to be continuous with each other via a fan-like connecting plate 34, further, contiguous ones of the outer side half circular portions 33B are made to be continuous with each other via a flat-plate-like connecting plate 35.

In a state of combining the half divisions 31, the flat-plate-like connecting portions 35 are brought into close contact with each other in a face contact state, further, an inner cylinder portion 36A in correspondence with or brought into close contact with the outer periphery of the electric wire 25 is configured by the inner side half circular portion 33A on the upper side and the inner side half circular portion 33A on the lower side, and an outer cylinder portion 36B which is concentric with the inner cylinder portion 36A and a front end portion of which is in correspondence with or brought into close contact with the inner periphery of the cavity 11 is configured by the outer side half circular portion 33B on the upper side and the outer side half circular portion 33B on the lower side. In the front and rear direction, although a front end of the inner cylinder portion 36A and a front end of the outer cylinder portion 36B are disposed substantially at the same position, a rear end of the outer cylinder portion 36B is disposed considerably rearward from a rear end of the inner cylinder portion 36A. The fan-like connecting portion 34 is disposed to be more proximate to a front end of the inner cylinder portion 36A than a center portion thereof in the front and rear direction. Whereas a front end of the flat-plate-like connecting portion 35 is substantially flush with a front end edge of the outer cylinder portion 36B, a rear end of the flat-plate-like connecting portion 35 is disposed frontward from a rear end of the outer cylinder portion 36B.

The rubber plug holder 30 is integrated to the housing 10 in a state of being restricted from being detached therefrom by locking a drawout preventing projection 30*a* formed at an outer face of the outer cylinder portion 36B (outer side half circular portion 33B) to a drawout preventing hole 14 of the housing 20. In the integrated state, the outer cylinder portion 36B is considerably projected from a rear end of the housing 10, that is, a rear end edge of the shield shell 16 to the rear side. Further, when the electric wire 25 is deviated from a regular wiring path (a path straightly extended substantially horizontally from the housing 10) indicated by a chain line in FIG. 1 to an upper side or a lower side to be folded back to the front side, the outer cylinder portion 36B functions as protecting member for protecting the resin cover 25*b* of the electric wire 25 against interference with the shield shell 16.

Next, operation of the embodiment will be explained.

When the electric wire 25 is bent to deviate from the regular wiring path to the lower side, as shown by FIG. 1, the electric wire 25 is bent by an acute angle (although in FIG. 1, the angle is substantially 30° through 40°, depending on an external force or a direction relative to the electric wire 25, the angle is larger or smaller than the illustrated angle) to be folded back to the front side at a vicinity of an extended end of the extended end portion 39 and the resin cover 25*b* of the outer periphery of the, electric wire 25 is brought into contact with the rear end edge of the shield shell 16.

Here, the electric wire 25 is bent in a state of being brought into contact with an extended end (rear end) of the outer cylinder portion 36B, which serves as the protecting member. The outer cylinder portion 36B is spaced -from an outer periphery of the electric wire 25, and extends rearward beyond rear ends of the housing 10 and the shield shell 16. Thereby, the electric wire 25 is brought into contact with the shield shell 16 in an attitude to be along an outer peripheral face of the shield shell (attitude constituting a small angle of about 30° through 40° relative to the outer peripheral face of the shield shell 16). Therefore, even when the resin cover 20*b* is brought into contact with an edge of a rear end of the shield shell 16, there is not a concern of impairing the electric wire 25 by the edge of the rear end of the shield shell 16.

Figure 2:
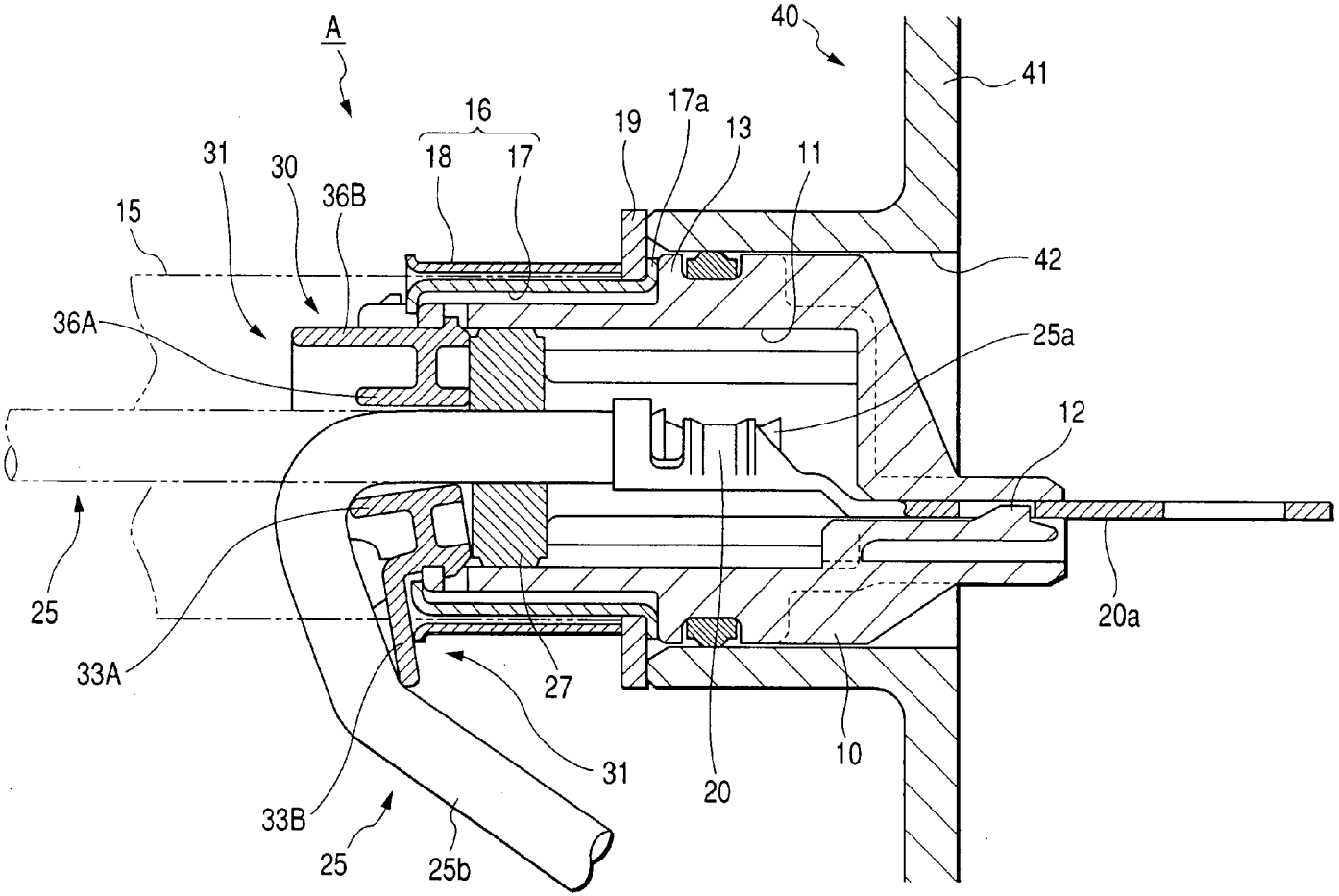
FIG. 2 is a sectional view showing other mode of the state of bending the electric wire.
Figure 3:
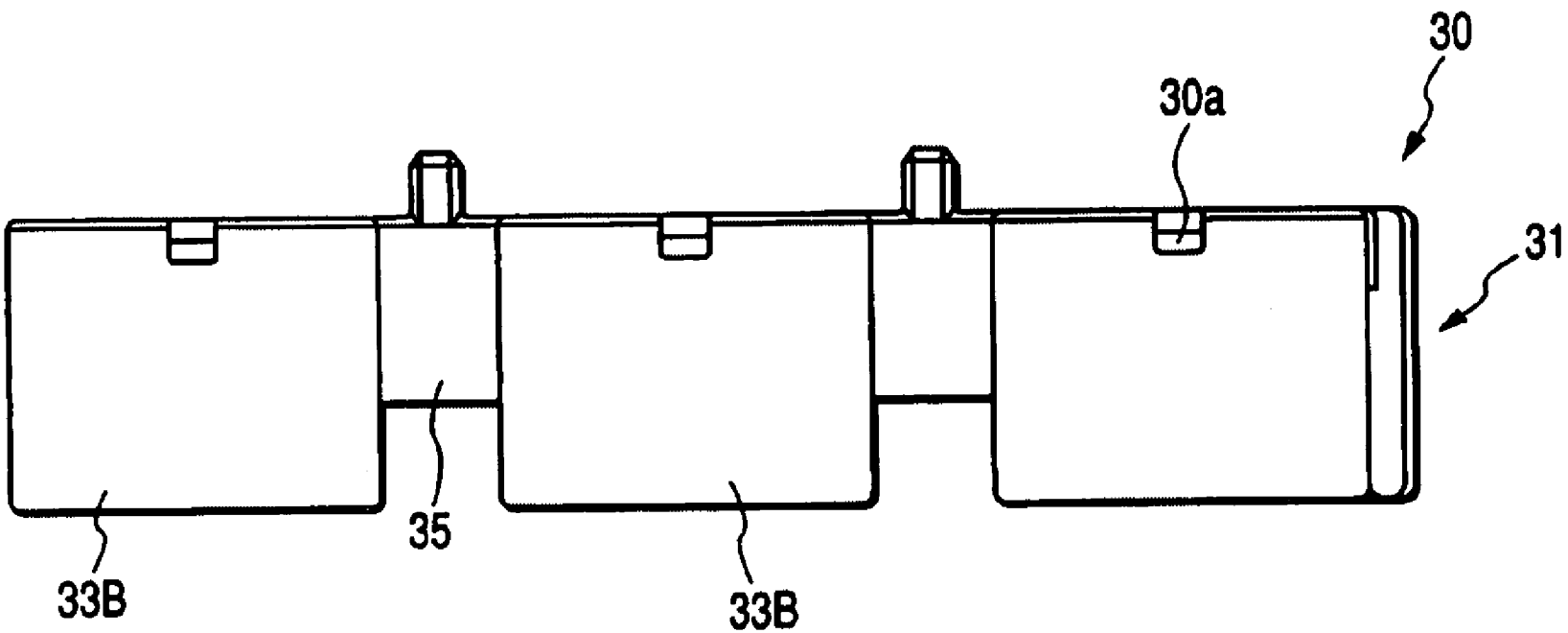
FIG. 3 is a plane view of a rubber plug holder.
Figure 4:
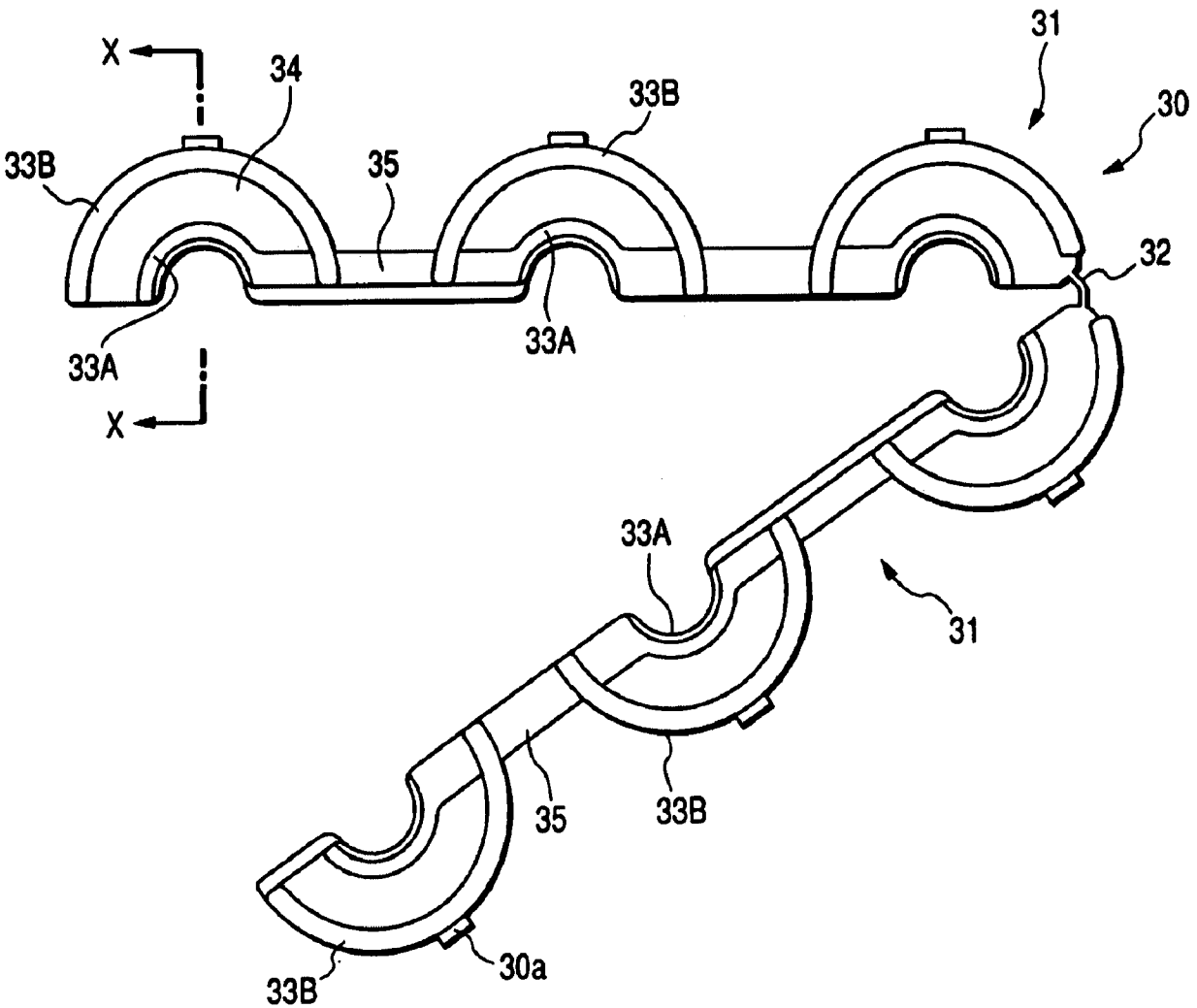
FIG. 4 is a rear view of the rubber plug holder.
Figure 5:
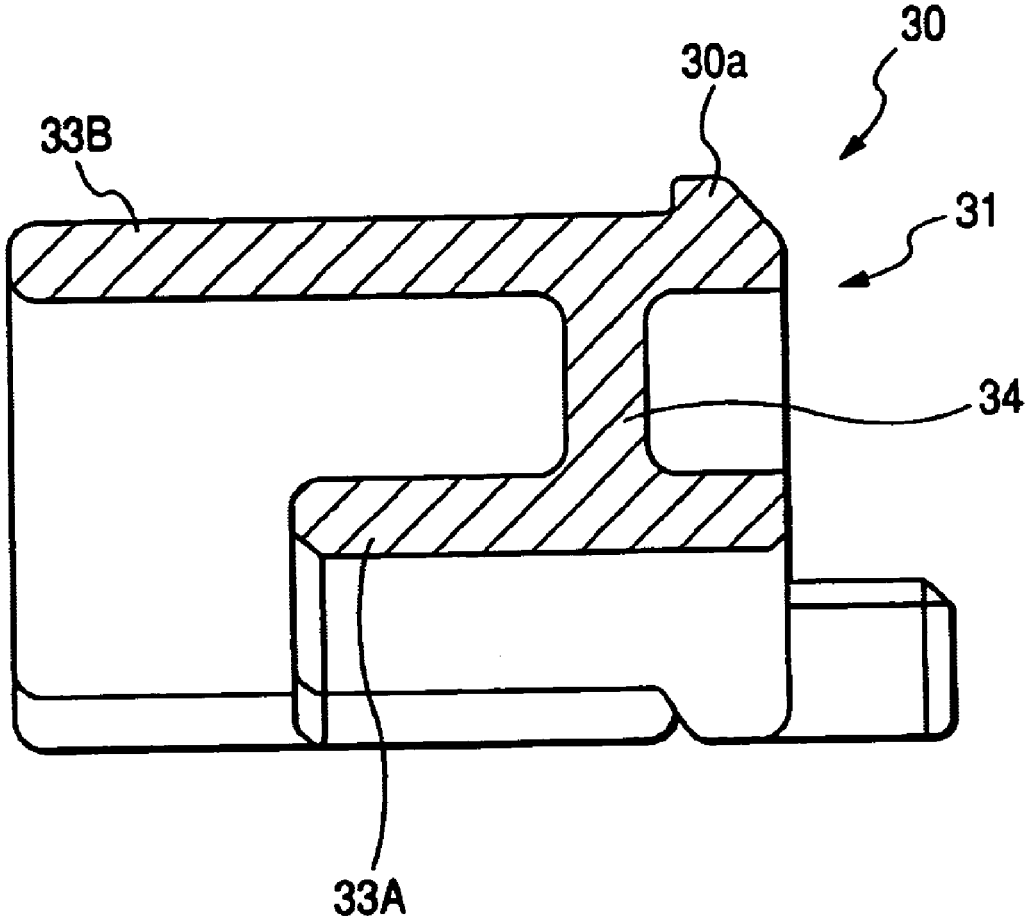
FIG. 5 is a sectional view taken along a line X—X of FIG. 4.

Further, when a force for bending the electric wire 25 is stronger than that of the case of FIG. 1, as shown by FIG. 2, the outer side half circular portion 33B on the lower side is deformed to bend (the deformation may be an elastic deformation or a plastic deformation) substantially in a right angle to the lower side by constituting a fulcrum by a vicinity of a rear end edge of a flat-plate-like connecting portion 35 by being overcome by a press force from a side of the electric wire 25. Then, there is brought about a state of interposing the deformed outer side half circular portion 33B between the electric wire 25 and the rear end edge of the shield shell 16. Thereby, the electric wire 25 is prevented from being brought into direct contact with the shield shell 16 to thereby avoid the resin cover 25*b* of the electric wire 25 from being impaired by the shield shell 16.

Further, according to the embodiment, the rubber plug holder 30 is in a mode of combining the pair of upper and lower half divisions 31, the outer cylinder portion 36B is configured by combining the two upper and lower outer side half circular portions 33B and therefore, there is also achieved an advantage that when the electric wire 25 is bent to the upper side or the lower side, the outer side half circular portion 33B is easy to deform. Further, the outer side half circular portion 33B (outer cylinder portion 36B) is in a mode of being projected in a shape of a cantilever rearward from the flat-plate-like connecting portion 35 and therefore, the outer side half circular portion 33B is made to be easy to deform also by such a shape.

Further, according to the embodiment, the rubber plug holder 30 is formed with protecting member for protecting the resin cover 25*b* against interference with the shield shell 16 when the electric wire 25 is bent to be deviated from the regular wiring path (that is, outer cylinder portion 36B)i the rubber plug holder 30 serves also as the protecting member and therefore, in comparison with the case of providing an exclusive part as protecting member, a number of parts is reduced.

Further, although the outer cylinder portion 36B is disposed at a position of being remote from the inner cylinder portion 36A to the outer side in the diameter direction, an extended end of the inner cylinder portion 36A is disposed to a depth side frontward from an extended end of the outer cylinder portion 36B and therefore, when the electric wire

25 is bent to wire, a degree of freedom of setting the wiring path is not reduced by presence of the outer cylinder portion 36B.

OTHER EMBODIMENTS

The invention is not limited to the embodiment explained by the above-described description and the drawings but, for example, the following embodiments are included in the technical range of the invention, further, the invention can be embodied by being variously changed within the range not deviated from the gist other than described below.

(1) A rubber part or a resin part may be outwardly fitted to the shield shell as protecting member to thereby prevent the shield shell from being brought into direct contact with the resin cover.

(2) A reinforcing layer may be provided at an outer periphery of the resin cover as protecting member to thereby avoid interference between the resin cover and the shield shell when the resin cover is brought into contact with the shield shell.

(3) The inner cylinder portion of the rubber plug holder may be extended to the rear side as protecting member.

(4) A portion of the housing extended to the rear side may configure protecting member without providing protecting member at the rubber plug holder, or an exclusive part as protecting member may be integrated to the housing.

EMBODIMENT 2

An explanation will be given of Embodiment 2 embodying the invention in reference to FIG. 6 through FIG. 10 as follows.

A shield connector A according to the embodiment is provided with a housing 10 made of a synthetic resin, and three (although according to the embodiment, three, may be two or four or more) of terminal metal pieces 20. Inside of the housing 10 is formed with three cavities 11 having a circular section penetrated in a front and rear direction to align by a constant pitch in a left and right direction (horizontal direction). The terminal metal pieces 20 are respectively inserted into the respective cavities 11 from a rear side and prevented from being drawn out by lances 12.

A rear end portion of the terminal metal piece 20 is connected with an electric wire 25 configured by surrounding an outer periphery of a core wire 25*a* by an insulating resin cover 25*b* by being brought into press contact therewith. An outer periphery of the resin cover 25*b* of the electric wire 25 constituting a circular shape is outwardly fitted with a rubber plug 27 in a cylindrical shape in liquid tight, an outer periphery of the rubber plug 27 is brought into close contact with an inner periphery of the cavity 11 in liquid tight and an interval between the outer periphery of the electric wire 25 and the inner periphery of the cavity 11 is waterproofed.

Further, a rear end portion of the housing 10 is attached with a rubber plug holder 30 for restricting the rubber plug 27 at inside of the cavity 11 from being detached to the rear side. The electric wire 25 is led out to the rear side by penetrating the rubber plug holder 30. Further, a detailed description will be given later of the rubber plug holder 30.

The housing 10 is fitted to an attaching hole 42 of a shield case 41 of an apparatus 40 (for example, an inverter apparatus, a motor or the like of an electric automobile), and a tab 20*a* of the terminal metal piece 20 projected from a front end of the housing 10 is connected to an apparatus side terminal, not illustrated.

Three pieces of the electric wires 25 are surrounded by a shield member 15 constituting a shape of a cylinder braided with metal slender wires in a mesh-like shape and the three pieces of electric wires 25 are summerizingly shielded by the shield member 15. A distal end portion of the shield member 15 is fixedly attached with a shield shell 16 made of a metal constituting a laterally prolonged oval shape (ring shape). The shield shell 16 is configured by a double cylinder structure of an inner ring 17 and an outer ring 18 and the distal end portion of the shield member 15 is pinched between the inner ring 17 and the outer ring 18 to be fixedly attached thereto by calking. The shield shell 16 is integrated with a bracket 19 integrated with the shield shell 16 by being pinched between a flange portion. 17*a* of a front end portion of the inner ring 17 and a front end edge of the outer ring 18. The shield shell 16 is conductively integrated to the shield case 41 by fixing the bracket 19 to the shield-case 41, in the integrated state, a front face of the bracket 19 is brought into contact with an enlarged diameter portion 13 at an outer periphery of the housing 10 fitted to the attaching hole 42 of the shield case 41 and by bringing the front face into contact with the enlarged diameter portion 13, the housing 10 is restricted from being detached from the attaching hole 42.

In a state of attaching the housing 10 and the shield shell 16 to the shield case 41 in this way, there is brought about a state of outwardly fitting the shield shell 16 to the outer periphery of the rear end portion of the housing 10, and a rear end edge of the shield shell 16 and a rear end of the housing 10 are disposed substantially at the same position in the front and rear direction. Therefore, according to a shield connector B having a structure of a related art shown in FIG. 10, when the electric wire 25 led out from the rubber plug holder 30 to the rear side is bent to be folded back to a lower side, the electric wire 25 is brought into contact with the rear end edge of the shield shell 16 to be butted thereto from the rear side and therefore, there is a concern of impairing the resin cover 25*b* by the edge of the rear end edge of the shield shell 16. Hence, according to the embodiment, the rubber plug holder 30 is provided by a structure of a countermeasure thereagainst. A detailed structure thereof will be explained as follows.

The rubber plug holder 30 comprises a single part configured by connecting left ends of a pair of half divisions 31 symmetrical with each other in an up and down direction by a hinge 32. The half division 31 on an upper side and the half division 31 on a lower side are formed with respective threes of inner side half circular portions 33A in a half circular shape and outer side half circular portions 33B concentric with the inner side half circular portions 33A and having a diameter larger than that of the inner side half circular portions 33A in correspondence with outer peripheries of the respective electric wires 25 (resin covers 25*b*) aligned in the left and right direction. The inner side half circular portion 33A and the outer side half circular portion 33B brought into a concentric relationship are made to be continuous with each other via a fan-like connecting plate 34, further, contiguous ones of the outer side half circular portions 33B are made to be continuous with each other via a flat-plate-like connecting plate 35.

In a state of combining the half divisions 31, the flat-plate-like connecting portions 35 are brought into close contact with each other in a face contact state, further, an inner cylinder portion 36A in correspondence with or brought into close contact with the outer periphery of the electric wire 25 is configured by the inner side half circular portion 33A on the upper side and the inner side half circular portion 33A on the lower side, and an outer cylinder portion 36B which is concentric with the inner cylinder portion 36A and a front end portion of which is in correspondence with or brought into close contact with the inner periphery of the cavity 11 is configured by the outer side half circular portion 33B on the upper side and the outer side half circular portion 33B on the lower side. In the front and rear direction, a front end of the inner cylinder portion 36A and a front end of the outer cylinder portion 36B are disposed substantially at the same position and a rear end of the outer cylinder portion 36B is disposed slightly rearward from a rear end of the inner cylinder portion 36A.

Further, the fan-like connecting plates 34 is disposed to be proximate to the front end of the inner cylinder portion 36A relative to a center thereof in the front and rear direction. Although a front end of the flat-plate-like connecting portion 35 is substantially flush with a front end edge of the outer cylinder portion 36B, a rear end of the flat-plate-like connecting portion 35 is disposed frontward from the rear end of the outer cylinder portion 36B.

Further, a reinforcing portion 37 constituting a rib-like shape in the up and down direction is formed between the outer periphery of the inner side half circular portion 33A and the inner periphery of the outer side half circular portion 33B. The reinforcing portion 37 is disposed at a center in the left and right direction of the half circular portion and is continuous to the fan-like connecting plate 34. A region formed with the reinforcing portion 37 is formed with a guiding face 38 reaching a rear end face of the outer side half circular portion 33B from an inner peripheral face of the inner side half circular portion 33A via the rear end face of the reinforcing portion 37 having a narrow width. The guiding face 38 configures a taper shape or an arc shape a diameter of which is gradually enlarged from the inner periphery of the inner side half circular portion 33A to the rear side. Further, in a region which is not formed with the reinforcing portion 37 (substantially quarter circular arc regions on two left and right sides of the reinforcing portion 37), a rear end face of the inner side half circular portion 33A as well as a rear end face of the outer side half circular portion 33B are also formed with side faces 38 in a circular arc shape in a mode the same as that of the guide face 38.

The rubber plug holder 30 is integrated to the housing 10 in a state of being restricted from being detached therefrom by locking a drawout preventing projection 30*a* projected from an outer face of the outer cylinder portion 36B (outer side semicircular portion 33B) by a drawout preventing hole 14 of the housing 10. In the integrated state, the outer cylinder portion 36B and the inner cylinder portion 36A are considerably projected to the rear side from the rear end of the housing 10, that is, the rear end edge of the shield shell 16. Further, when the electric wire 25 is deviated from the regular wiring path (a path extended straightly substantially in a horizontal direction from the housing 10) to the upper side or the lower side and bent to be folded back to the front side, the inner cylinder portion 36A and the outer cylinder portion 36B configure an extended portion 39 functioning as protecting member for protecting the resin cover 25*b* of the electric wire 25 against interference with the shield shell 16.

Next, operation of the embodiment will be explained.

Figure 6:
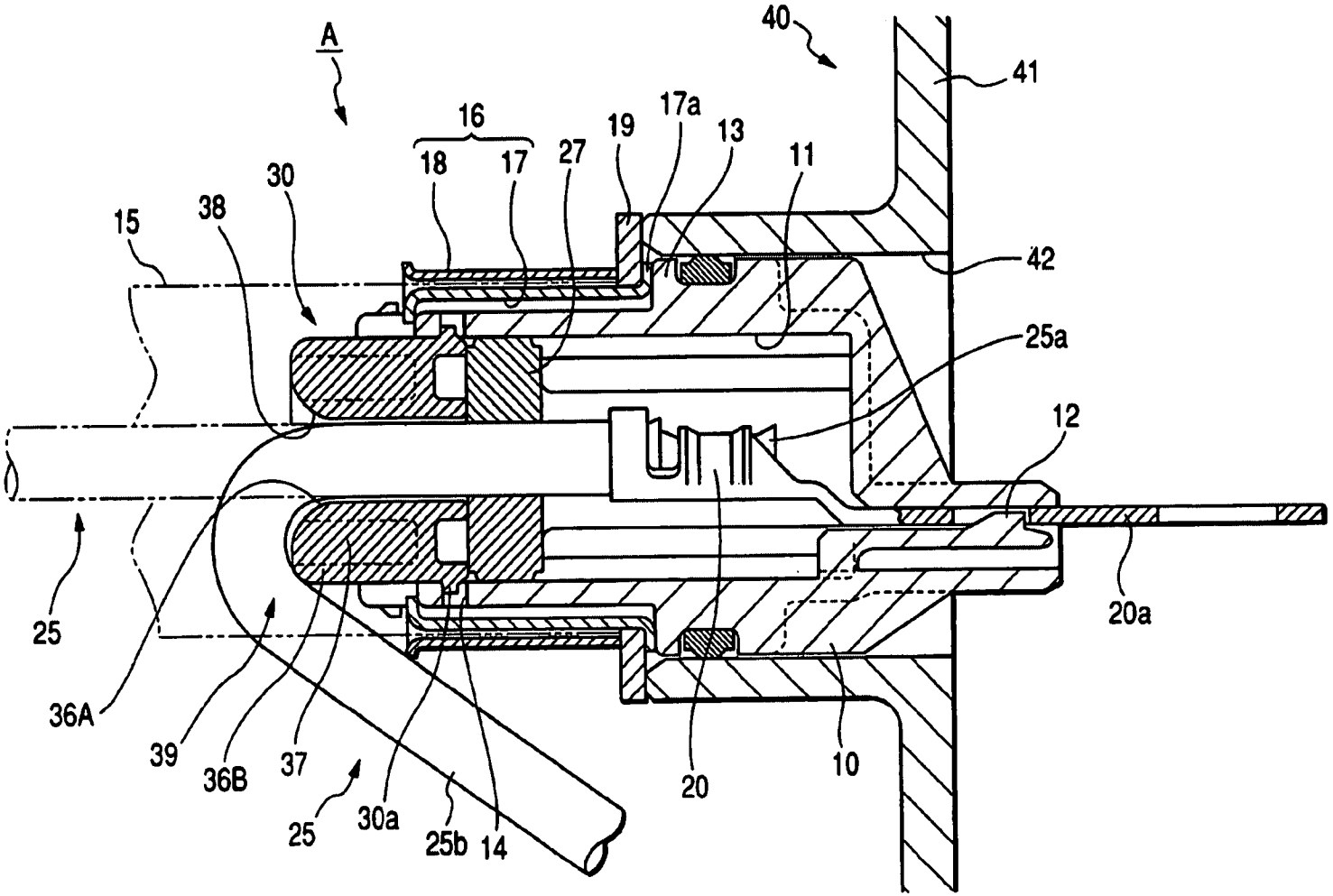
FIG. 6 is a sectional view showing a state of bending an electric wire according to Embodiment 2.
Figure 7:
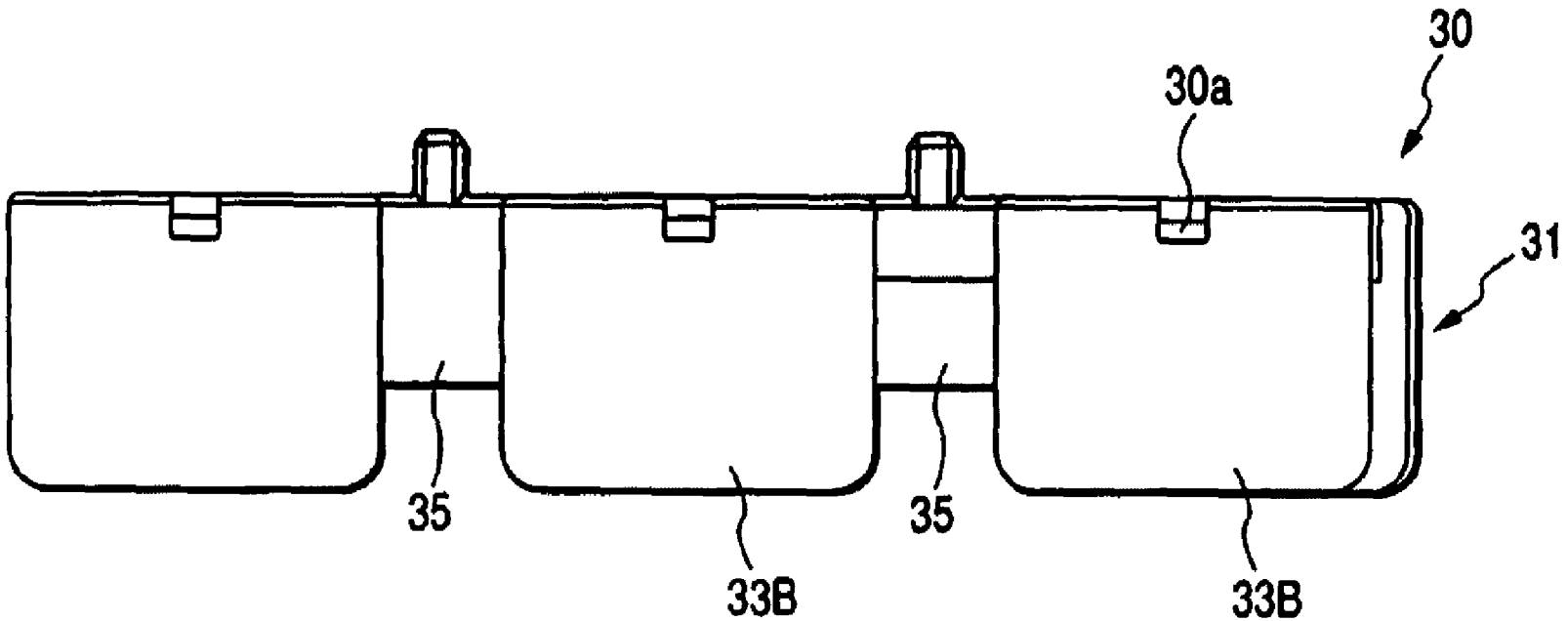
FIG. 7 is a plane view of a rubber plug holder.
Figure 8:
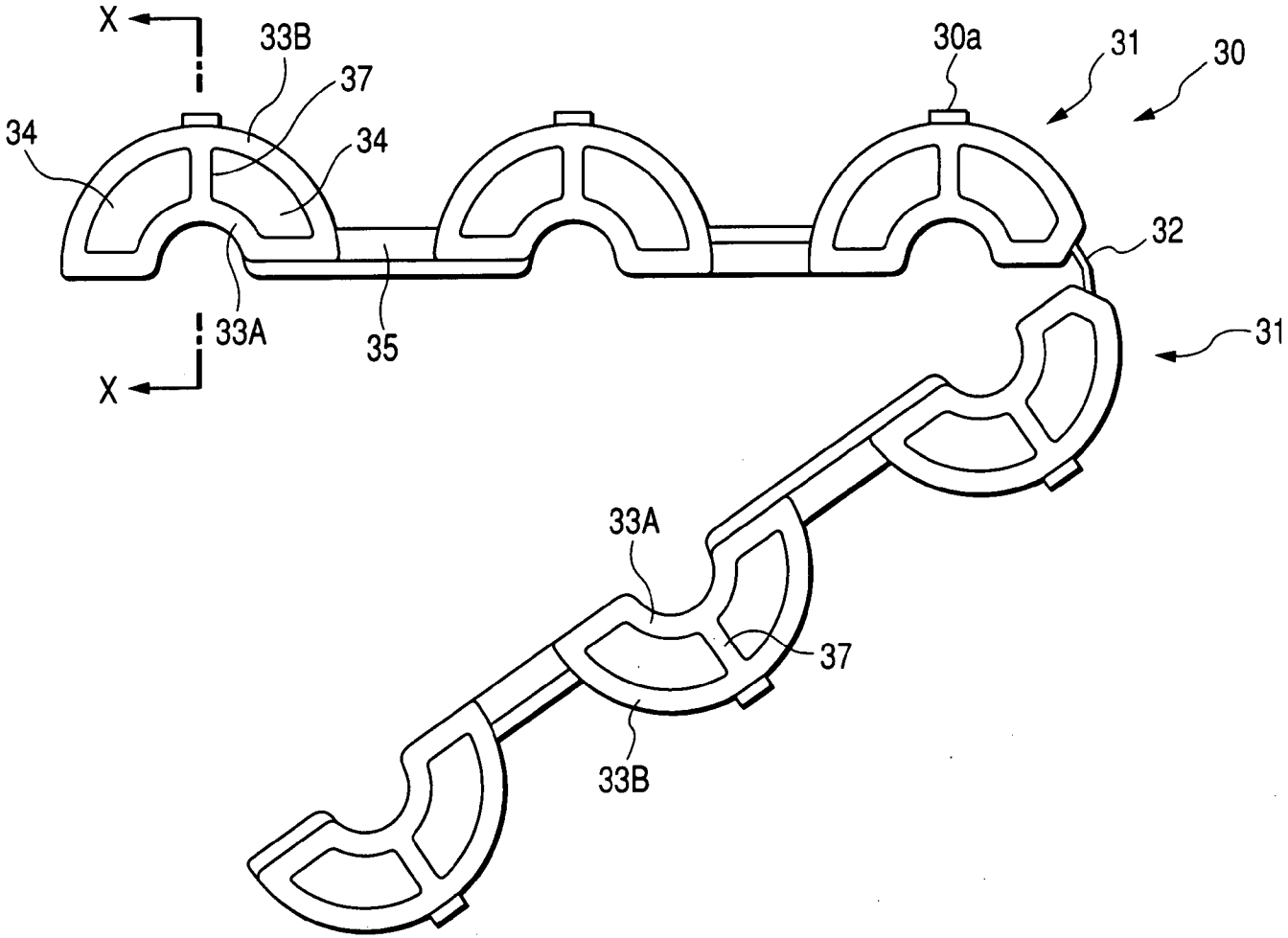
FIG. 8 is a rear view of the rubber plug holder.
Figure 9:
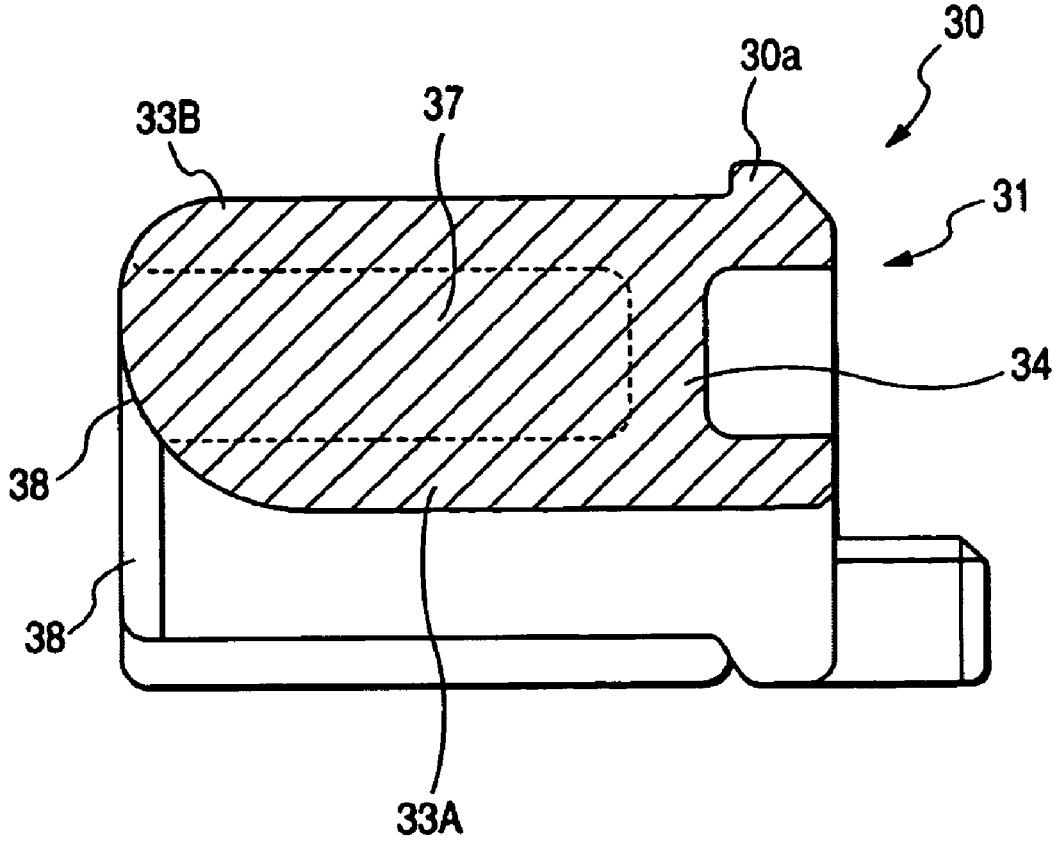
FIG. 9 is a sectional view taken along a line X—X of FIG. 8.
Figure 10:
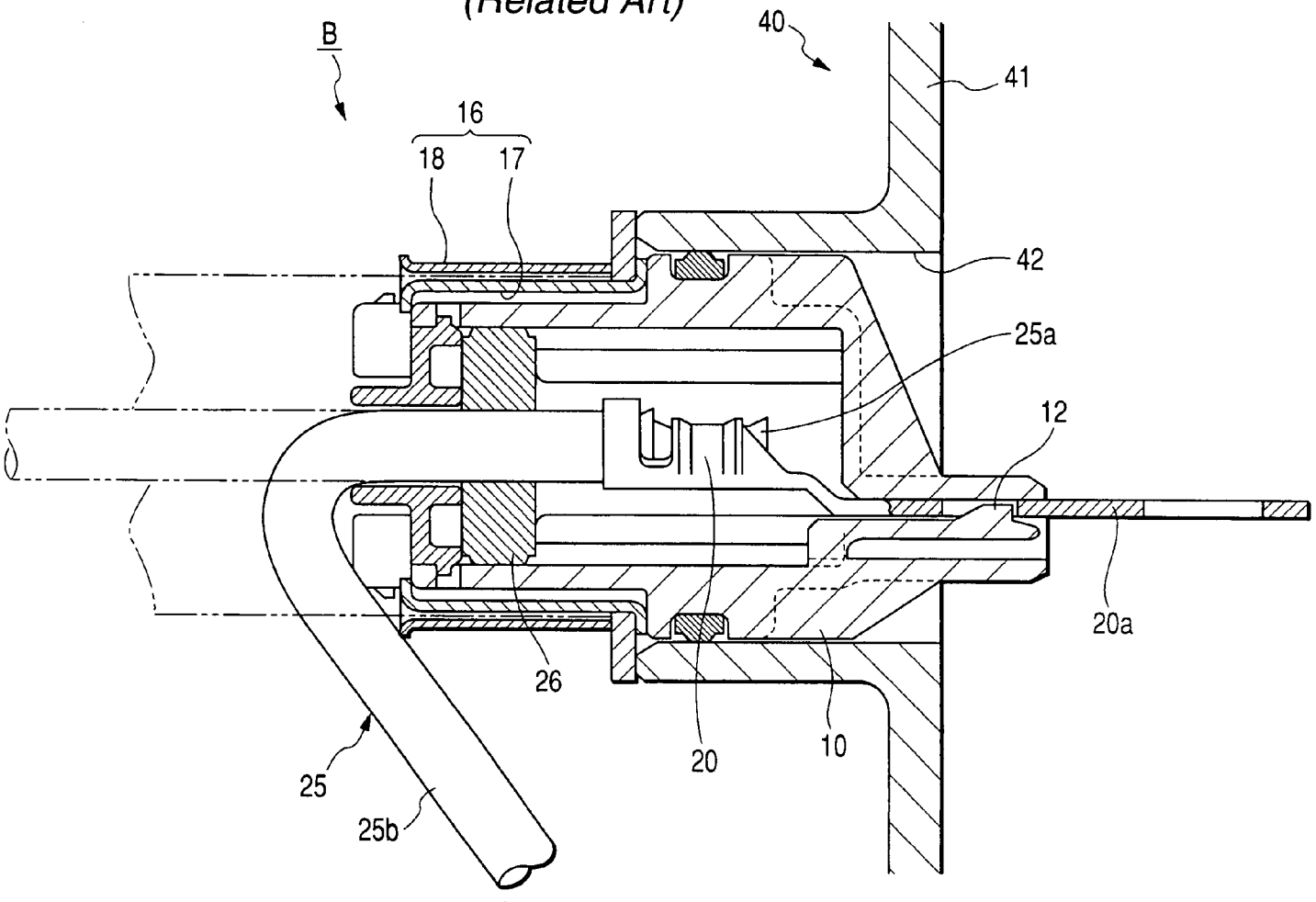
FIG. 10 (Related Art)
FIG. 10 is a sectional view showing a state of bending an electric wire in a related art.

When the electric wire 25 is bent to deviate from the regular wiring path to the lower side, as shown by FIG. 6, the electric wire 25 is bent by an acute angle (although in FIG. 6, the angle is substantially 30° through 40°, depending on an external force or a direction relative to the electric wire 25, the angle is larger or smaller than the illustrated angle) to be folded back to the front side at a vicinity of an extended end of the extended end portion 39 and the resin cover 25*b* of the outer periphery of the electric wire 25 is brought into contact with the rear end edge of the shield shell 16.

At this occasion, the electric wire 25 is bent in a state of being brought into contact with the extended end of the outer cylinder portion 36B of the extended portion 39, the outer cylinder portion 36B is separated from the outer periphery of the electric wire 25 to an outer side in the diameter direction, and is configured by a mode of being extended rearward from the housing 10 and the rear end of the shield shell 16. Thereby, the electric wire 25 is brought into contact with the shield shell 16 in an attitude to be along an outer peripheral face thereof (attitude constituting a small angle of about 30° through 40° relative to the outer peripheral face of the shield shell 16).

That is, the shield connector A of the embodiment is provided with the extended portion 39 in a mode in which a region thereof at a face of leading out the electric wire 25 on an outer peripheral side of the electric wire 25 is extended rearward from the shield shell 16 and therefore, the electric wire 25 deviated from the regular wiring path to bend to the front side is folded back at the rear end of the extended portion 39 separated from the shield shell 16 and even when the bent electric wire 25 is brought into contact with the shield shell 16, the electric wire 25 at that occasion is configured by the attitude of being along the outer peripheral face of the shield shell 16. Therefore, there is not a concern of impairing the resin cover 25*b* even when the resin cover 25*b* is brought into contact with the edge of the rear end of the shield shell 16.

Further, since the reinforcing portion 37 capable of restricting the extended portion 39 from being deformed, there is not a concern of deforming the extended portion 39 by being exerted with a press force from the electric wire 25 and the extended portion 39 can firmly achieve the function of protecting the electric wire 25 against interference with the shield shell 16.

Further, according to the embodiment, the rubber plug holder 30 is formed with the extended portion 39 as the protecting member for protecting the resin cover 25*b* against interference with the shield shell 16 when the electric wire 25 is deviated from the regular wiring path to be bent, the rubber plug holder 30 serves also as the protecting member and therefore, in comparison with the case of providing an exclusive part as protecting member, a number of parts is reduced.

Further, since the extended portion 39 is configured by the double cylinder portions of the inner cylinder portion 36A and the outer cylinder portion 36B, in comparison with a case of constituting the extended portion 39 by a cylinder portion having a single wall thickness, material cost can be reduced and further, a sink mark in molding by a die can be restrained. Further, although wall thicknesses of the inner cylinder portion 36A and the outer cylinder portion 36B are thin, the cylinder portions 36A, 36B are firmly prevented from being deformed by the reinforcing portion 37 constituting the shape of the rib in the diameter direction.

Further, by forming the guide face 38 in the taper shape or the arc shape a diameter of which is enlarged from the inner peripheral face to the rear side at the extended end portion of the extended portion 39, the electric wire 25 is bent unforcibly by a comparatively large radius of curvature along the guide face 38 and therefore, a degree of freedom of setting the wiring path is high when the electric wire 25 is wired to be bent at the vicinity of the housing 10.

OTHER EMBODIMENTS

The invention is not limited to the embodiment explained by the above-described description and the drawings but, for example, the following embodiments are included in the technical range of the invention, further, the invention can be embodied by being variously changed within the range not deviated from the gist other than described below.

(1) A reinforcing layer may be provided at the outer periphery of the resin cover as protecting member to avoid interference between the resin cover and the shield shell when brought into contact with the shield shell.

(2) In the inner cylinder portion and the outer cylinder portion constituting the extended portion, the inner cylinder portion may be extended rearward from the outer cylinder portion.

(3) An extended portion may be configured by a portion of the housing extended to the rear side without providing the extended portion at the rubber plug holder, or an exclusive part having an extended portion may be integrated to the housing.

(4) An extended portion may be configured by a cylinder portion having a single wall thickness without constituting the extended portion by the double cylinder structure of the inner cylinder portion and the outer cylinder portion.

What is claimed is:

1. A shield connector comprising:

a terminal metal piece connected to an electric wire, an outer periphery of the electric wire being covered with an insulating resin cover, the terminal metal piece being accommodated in a housing;

a shield shell made of a metal, the shield shell being fixedly attached to a shield member surrounding the electric wire, the shield shell being attached to an outer periphery of the housing; and a member that includes (i) a radial portion that extends radially outward from the electric wire, (ii) an inner cylindrical wall portion that protrudes from the radial portion and extends along an outer periphery of the electric wire and (iii) an outer cylindrical wall portion that protrudes from the radial portion and is substantially concentric with the inner cylindrical wall portion, the outer cylindrical wall portion being spaced from the inner cylindrical wall portion in a radial direction, such that an empty space is defined between the outer cylindrical wall portion and the inner cylindrical wall portion, wherein the outer cylindrical wall portion serves as a protecting member that protects the insulating resin cover against interference with the shield shell when the electric wire is bent to be deviated from a regular wiring path.

2. The shield connector according to claim 1, wherein when the electric wire is bent, the electric wire deforms the protecting member and causes the protecting member to interpose between an end face of the shield shell and the resin cover.

3. The shield connector according to claim 1, wherein the protecting member is part of a rubber plug holder which prevents a rubber plug, through which the electric wire penetrates, from being drawn out.

4. The shield connector according to claim 3, wherein:

the rubber plug holder includes (i) an inner cylinder portion that extends along an outer periphery of the electric wire and (ii) an outer cylinder portion substantially concentric with the inner cylinder portion, the outer cylinder portion being spaced from the inner portion in a radial direction and extending along an inner periphery of the housing, a rear end of the outer cylinder portion extends rearward beyond a rear end of the shield shell, and the outer cylinder portion serves as the protecting member.

5. The shield connector according to claim 4, wherein a rear end of the inner cylinder portion is disposed frontward compared to the rear end of the outer cylinder portion.

6. The shield connector according to claim 1, wherein the protecting member comprises (i) an extended portion that extends rearward beyond the shield shell and (ii) a reinforcing portion that restricts the extended portion from being deformed.

7. The shield connector according to claim 6, wherein the extended portion is formed at a rubber plug holder which prevents a rubber plug, through which the electric wire penetrates, from being drawn out of the housing.

8. The shield connector according to claim 7, wherein:

the rubber plug holder includes (i) an inner cylinder portion that extends along an outer periphery of the electric wire and (ii) an outer cylinder portion substantially concentric with the inner cylinder portion, the outer cylinder portion being spaced from the inner portion in a radial direction and extending along an inner periphery of the housing, the extended portion is configured by the inner cylinder portion and the outer cylinder portion, and the reinforcing portion includes a rib connecting the inner cylinder portion and the outer cylinder portion in a diameter direction.

9. The shield connector according to according to claim 6, wherein a rear end portion of the extended portion includes a guide face in a taper shape or an arc shape, an internal diameter of the guide face increasing with progression rearward.

10. The shield connector according to according to claim 2, wherein the electric wire deforms the protecting member about 90° from an original position of the protecting member.

11. The shield connector according to according to claim 1, wherein when the electric wire is bent and caused to push against the protecting member, the electric wire does not contact an edge of the shield shell until an angle of the wire with respect to a peripheral face of the shield shell has decreased to 40° or less.

12. The shield connector according to according to claim 6, wherein when the electric wire is bent and caused to push against the protecting member, the electric wire does not contact an edge of the shield shell until an angle of the wire with respect to a peripheral face of the shield shell has decreased to 40° or less.

* * * * *